US007874697B2

(12) United States Patent
Biebel et al.

(10) Patent No.: US 7,874,697 B2
(45) Date of Patent: Jan. 25, 2011

(54) LAMP

(75) Inventors: Ulrich Biebel, Rennertshofen (DE); Jens Clark, Ebersberg (DE); Udo Custodis, Happy Valley (HK); Ulrich Henger, Eichenau (DE)

(73) Assignee: OSRAM Gesellschaft mitbeschränkter Haftung, München (DE)

( * ) Notice: Subject to any disclaimer, the term of this patent is extended or adjusted under 35 U.S.C. 154(b) by 0 days.

(21) Appl. No.: 12/309,573

(22) PCT Filed: Aug. 6, 2007

(86) PCT No.: PCT/EP2007/058118

§ 371 (c)(1),
(2), (4) Date: May 4, 2009

(87) PCT Pub. No.: WO2008/017652

PCT Pub. Date: Feb. 14, 2008

(65) Prior Publication Data

US 2009/0243455 A1 Oct. 1, 2009

(30) Foreign Application Priority Data

Aug. 9, 2006 (DE) ..... 10 2006 037 376

(51) Int. Cl.
*F21S 4/00* (2006.01)

(52) U.S. Cl. ..... 362/225; 362/217.02; 362/217.05; 362/217.06; 362/217.07; 362/217.08; 362/218; 362/219; 362/228; 362/249.02; 362/294

(58) Field of Classification Search ..... 362/228, 362/249.02, 260, 217.02, 219, 221, 224, 362/225, 217.05–217.08, 294, 345, 547, 362/800

See application file for complete search history.

(56) References Cited

U.S. PATENT DOCUMENTS

| | | | | |
|---|---|---|---|---|
| 4,956,751 | A | 9/1990 | Kano | |
| 6,149,283 | A * | 11/2000 | Conway et al. | 362/236 |
| 6,848,819 | B1 | 2/2005 | Arndt et al. | |
| 6,982,518 | B2 * | 1/2006 | Chou et al. | 313/46 |
| 6,992,718 | B1 * | 1/2006 | Takahara | 348/333.09 |
| 7,052,157 | B1 | 5/2006 | Lau | |

(Continued)

FOREIGN PATENT DOCUMENTS

DE 39 16997 A1 12/1989

(Continued)

*Primary Examiner*—Sandra L O Shea
*Assistant Examiner*—Mary Zettl
(74) *Attorney, Agent, or Firm*—Holtz, Holtz, Goodman & Chick, P.C.

(57) ABSTRACT

The invention relates to a lamp with a first light source generating white light, comprising at least one fluorescent lamp (2) or an incandescent lamp, as well as a second light source comprising at least one set of light-emitting diodes (4, 5; 300), and comprising a reflector (1) for the light emitted by the light sources, wherein a cooling device (6, 7) for the at least one set of light-emitting diodes (4, 5) is attached to the reflector (1) and is thermally linked to the at least one set of light-emitting diodes (4, 5), and wherein the lamp comprises a translucent and light-dispersing medium (3) in the optical path of the light emitted by the lamp.

26 Claims, 6 Drawing Sheets

U.S. PATENT DOCUMENTS

Figure 1:
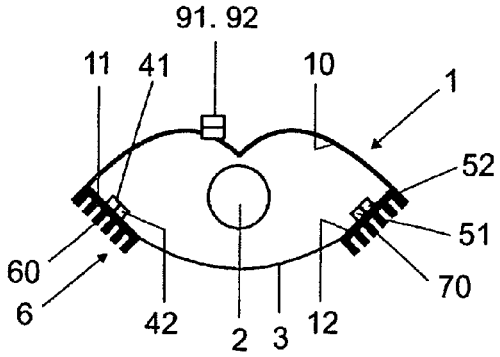

| | | | | |
|---|---|---|---|---|
| 7,090,375 | B2 * | 8/2006 | Kuisma | 362/225 |
| 2004/0218387 | A1 * | 11/2004 | Gerlach | 362/231 |
| 2004/0222516 | A1 | 11/2004 | Lin et al. | |
| 2005/0265023 | A1 * | 12/2005 | Scholl | 362/229 |
| 2007/0014549 | A1 * | 1/2007 | Demarest et al. | 392/393 |
| 2008/0191631 | A1 * | 8/2008 | Archenhold et al. | 315/158 |

FOREIGN PATENT DOCUMENTS

| | | | |
|---|---|---|---|
| DE | 39 16997 | C2 | 12/1989 |
| DE | 296 20 583 | U1 | 11/1996 |
| DE | 200 07 134 | U1 | 8/2000 |
| DE | 199 22 176 | A1 | 11/2000 |
| DE | 199 22 176 | C2 | 11/2000 |
| DE | 202 04 352 | U1 | 6/2002 |
| DE | 102 16 645 | A1 | 11/2003 |
| EP | 1 353 117 | A2 | 10/2003 |
| EP | 1 353 117 | A3 | 10/2003 |
| WO | WO 2006/086967 | A1 | 8/2006 |

* cited by examiner

LAMP

This application is a U.S. National Phase Application under 35 USC 371 of International Application PCT/EP2007/058118, filed Aug. 6, 2007, which is incorporated herein in its entirety by this reference.

The invention relates to a luminaire in accordance with claim 1.

SUMMARY OF THE INVENTION

It is an object of the invention to provide a luminaire that permits a color adaptive illumination.

This object is achieved according to the invention by the features of claim 1. Particularly advantageous designs of the invention are described in the dependent claims.

The inventive luminaire has a first light source which comprises at least one fluorescent lamp or one incandescent lamp and has a second light source, which comprises at least one light-emitting diode arrangement, and has a reflector for the light emitted by the light sources, a cooling device for the at least one light-emitting diode arrangement being provided that is thermally coupled to the at least one light-emitting diode arrangement and is arranged on the reflector, and the luminaire comprising a transparent, light-scattering means that is arranged in the beam path of the light emitted by the luminaire. The combination of the abovementioned features produces a luminaire that enables an adaptation of the hue and the color temperature of the light emitted by it within wide units. By means of the first light source, white light with a color locus and color temperature defined by the characteristics of this light source is generated, while, by means of the second light source, which comprises at least one light-emitting diode arrangement, the color locus or/and the color temperature is/are shifted to a desired value. In particular, the color locus of the luminaire can be shifted along the Planckian locus in FIG. 6 to color loci of lower color temperature by means of the at least one light-emitting diode arrangement. The at least one light-emitting diode arrangement comprises a combination of a number of light-emitting diodes that, owing to their small design size, can be placed in the vicinity of the first light source such that the light created by the two light sources can be homogeneously mixed by means of a reflector and a transparent light-scattering means, and the viewer can no longer assign the light emitted by the luminaire to the first or second light source. The cooling device required to operate the at least one light-emitting diode arrangement is arranged at the reflector, thus enabling simple mounting of the light-emitting diode arrangement and a good thermal coupling between the light-emitting diode arrangement and cooling device. With the aid of the inventive combination, it is possible to vary the color temperature of the white light emitted by the luminaire within wide limits, for example between 2700 kelvin and 6000 kelvin or alternatively to vary the hue of the light emitted by the luminaire over the entire color spectrum, from bluish to reddish.

The reflector advantageously has an inner side that faces the two light sources and is designed to reflect light, and an outer side averted from the light sources, and the cooling device for the at least one light-emitting diode arrangement being arranged on the outer side of the reflector. It is thereby possible to use the reflector for both light sources, and the cooling device is not heated up by the electromagnetic radiation emitted by the light sources.

In accordance with a preferred exemplary embodiment, for the purpose of ease of mounting, the cooling device is arranged at the edge of a light exit opening of the reflector.

The at least one light-emitting diode arrangement is advantageously arranged on the inner side of the reflector in order to enable simple mounting and optimal coupling to the light-reflecting surface of the reflector.

The at least one light-emitting diode arrangement is advantageously mounted on a surface of the cooling device, in order to ensure good thermal coupling between the light-emitting diodes and the cooling device. This surface of the cooling device preferably faces the outer side of the reflector, and the at least one light-emitting diode arrangement projects through one or more cutouts in the reflector, in order to permit simple and space-saving mounting of the light-emitting diode arrangement and of the associated cooling device on the reflector. The cooling device can thereby be fixed on the outer side of the reflector such that the light-emitting diode arrangement projects through the abovementioned cutouts. In order to ensure a better thermal insulation between the reflector and the heat sink, a thermal insulation layer can be arranged between the surface of the cooling device provided with the at least one light-emitting diode arrangement and the outer side of the reflector. This insulation layer can consist, for example, of a plastic of low thermal conductivity, or be formed by the reflector itself if the latter is fabricated from a plastic of low thermal conductivity and its inside reflecting light is designed, for example, as a metallic coating.

The cooling device advantageously has cooling ribs that are arranged in such a way that they lie outside the beam path of the light emitted by the luminaire. Consequently, the cooling ribs do not cause any occlusion and are not heated up by the light emitted by the luminaire. Alternatively, the cooling device can be designed as a cooling plate, for example made from an aluminum plate, over whose surface the heat produced by the luminaire is dissipated to the outside. In this case, it is advantageous to provide an interspace or cavity between the cooling plate and the reflector, in order for an operating device or an operating circuit for the light sources to be placed there.

In accordance with a preferred embodiment of the invention, the at least one light-emitting diode arrangement comprises a combination of red or orange shining light-emitting diodes with green shining light-emitting diodes, and the first light source comprises one or more fluorescent lamps. It is preferred to use fluorescent lamps that generate daylight-like light, that is to say light with a color temperature in the range from approximately 5400 kelvin to 6000 kelvin, during their operation. The combination of red and/or orange-colored light-emitting diodes with green light-emitting diodes can be used to generate white light of low color temperature, and the color temperature of the light emitted by the luminaire can be reduced to values of up to 2700 kelvin in an efficient way. Both the red and/or orange-colored and green light-emitting diodes have a higher efficiency than another color-complementary combination of light-emitting diodes such as, for example blue and yellow light-emitting diodes. Fluorescent lamps are preferred instead of incandescent lamps as first light source, because the former have a higher luminous efficiency, and daylight-like light can be generated by means of halogen incandescent lamps only with a high outlay on filter means and a low efficiency.

In accordance with another preferred exemplary embodiment, the at least one light-emitting diode arrangement comprises light-emitting diodes that generate warm white light, that is to say white light with a color temperature in the range from approximately 2700 kelvin to 3000 kelvin during their operation, and the first light source comprises one or more light-emitting diodes. It is preferred to use fluorescent lamps that generate daylight-like light during their operation. By means of combining the light-emitting diodes generating warm white light with the fluorescent lamp(s), it is possible for the color temperature of the light emitted by the luminaire likewise to be reduced in an efficient way.

In accordance with a further exemplary embodiment, the at least one light-emitting diode arrangement comprises a combination of red, green and blue shining light-emitting diodes. It is possible thereby for each luminous color of the color spectrum to be generated and mixed with the white light of the first light source such that the range of tones of the light emitted by the luminaire can be varied within wide limits. In particular, it is also possible to vary the color temperature of the light emitted by this luminaire.

In accordance with the preferred exemplary embodiments, the transparent, light-scattering means is arranged at the light exit opening of the reflector and designed as a cover pane, thus enabling simple mounting and ensuring that the entire light generated by the light sources must pass the light-scattering means.

The inventive luminaire is advantageously equipped with a color sensor that serves to control the color temperature or the color of the light emitted by the luminaire. The color sensor can be used to adapt the color temperature or the range of hues of the light emitted by the luminaire automatically to changes in the natural ambient light in the course of the day. Moreover, in an illumination system that comprises a number of the inventive luminaires, the color sensors can be used to carry out an exact color tuning of the individual luminaires to one another, for example, to adapt the illumination in a space to changes in the natural ambient light.

It is preferred for the inventive luminaire to be equipped with a brightness sensor that serves to control the brightness of the light emitted by the luminaire. The light sensor can be used to adapt to the brightness of the light emitted by the luminaire automatically to the change in the brightness of the natural ambient light in the course of the day. For the above-mentioned reasons, it is particularly preferred to combine a color sensor and a brightness sensor.

In accordance with a preferred exemplary embodiment of the inventive luminaire, which is chiefly provided for use in office or business spaces, the reflector is of trough-like design, the first light source is aligned parallel to the longitudinal extent of the trough-like reflector, and the second light source is formed by two light-emitting diode arrangements that are arranged on both sides of the first light source and respectively extend in a fashion parallel to the longitudinal extent of the reflector. The abovenamed reflector can be fabricated in a simple way, for example as a press-drawn section made from plastic, the inner side of the trough-shaped reflector being metallized, for example, in order to attain a high degree of light reflection. The two light-emitting diode arrangements are preferably respectively arranged along an edge of the trough-like reflector running parallel to the longitudinal extent. It is thereby possible to fix the associated cooling device at the edge of the reflector. The two light-emitting diode arrangements are respectively advantageously arranged along a reflector section bent back in the direction of the inside trough bottom, such that, before leaving the luminaire, the light emitted by the light-emitting diode arrangements is reflected at least once on the inner side, designed to reflect light, of the reflector. As a result, a better mixing of the light emitted by the two types of light source is achieved, and the individual light-emitting diodes are not visible through the light exit opening. The cooling devices of the two light-emitting diode arrangements preferably extend along the outer sides of the abovenamed bent-back reflector sections such that they can be fixed on these bent-back or angled-off reflector sections.

In accordance with another preferred exemplary embodiment of the inventive luminaire, which is primarily provided for use in private spaces or in the housing sector, the reflector is of hood-like and substantially rotationally symmetrical design, and the first light source is arranged along the rotation axis of the reflector, and the second light source comprises at least one annular or annular segment light-emitting diode arrangement that is arranged on the inner side and coaxially with the rotation axis of the reflector. This luminaire is suitable for illuminating only a specific part of a space, or for implementing accentuated illumination. The cooling device for the at least one annular or annular segment light-emitting diode arrangement is advantageously arranged on the outer side of the reflector, at the level of the light-emitting diode arrangement, in order to enable good thermal coupling between the light-emitting diodes and the cooling device, and simple mounting of the cooling device from the reflector, as well as to prevent the light emitted by the luminaire from heating up the cooling device. A fluorescent lamp with a base at one end and whose axis of longitudinal extent is aligned parallel to the rotation axis of the reflector preferably serves as first light source. Consequently, the reflector can be fixed on the base of the fluorescent lamp. In contrast with an incandescent lamp with a base at one end, the use of a fluorescent lamp with a base at one end has the advantage of a higher light efficiency. The fluorescent light with a base at one end is preferably a so-called compact fluorescent lamp that has an operating device integrated in the base. There is thus no need for a separate operating device for the luminaire.

DESCRIPTION OF THE PREFERRED EXEMPLARY EMBODIMENTS

Figure 2:
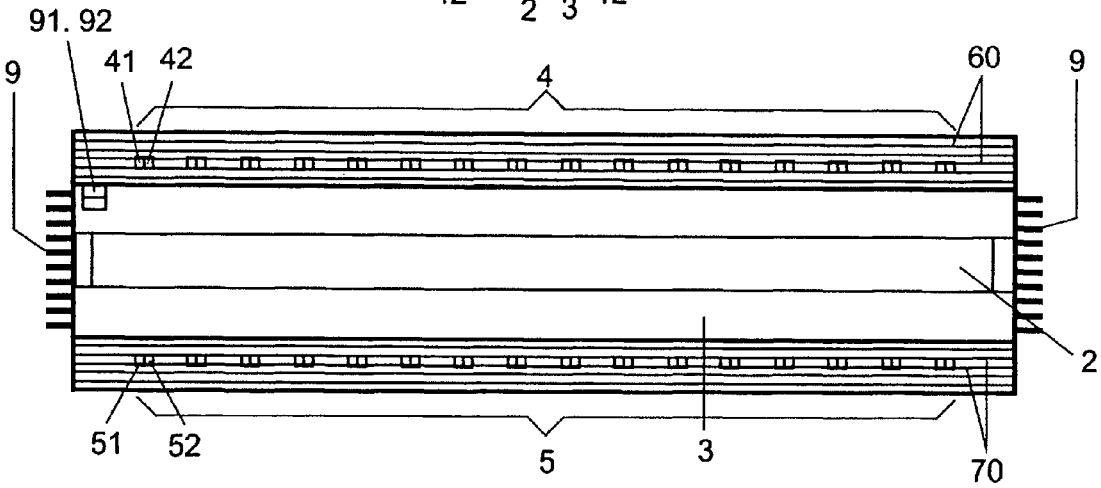
Figure 3:
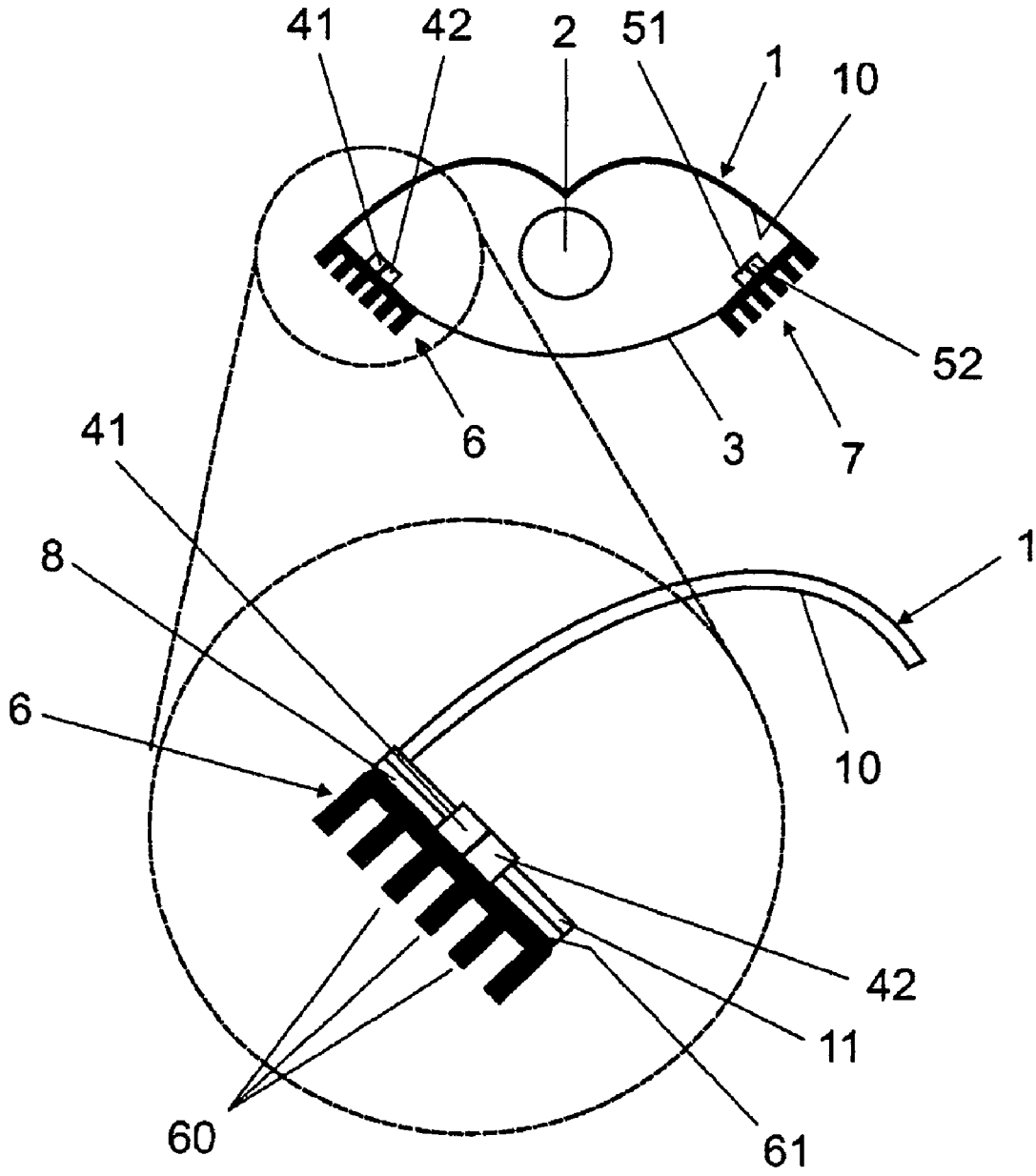
Figure 4:
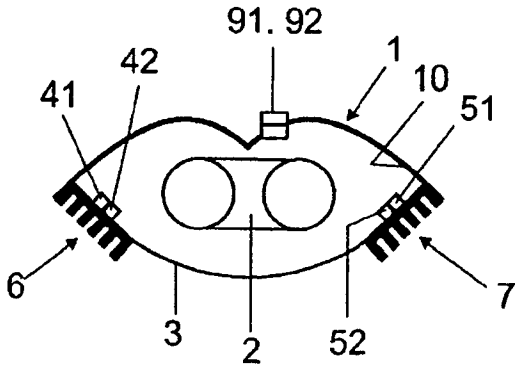
Figure 5:
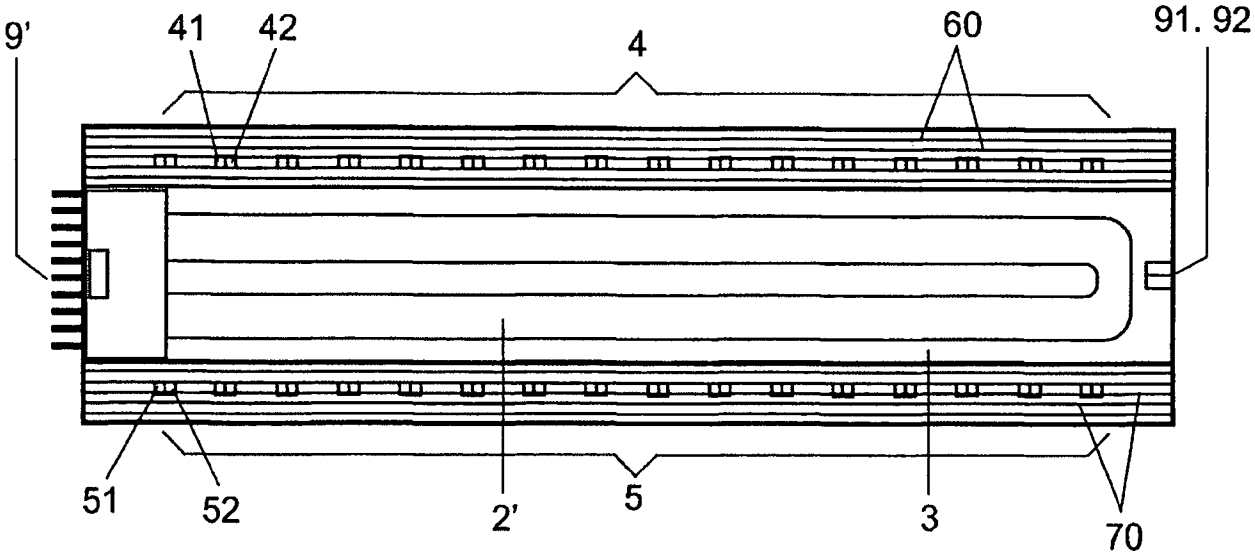
Figure 6:
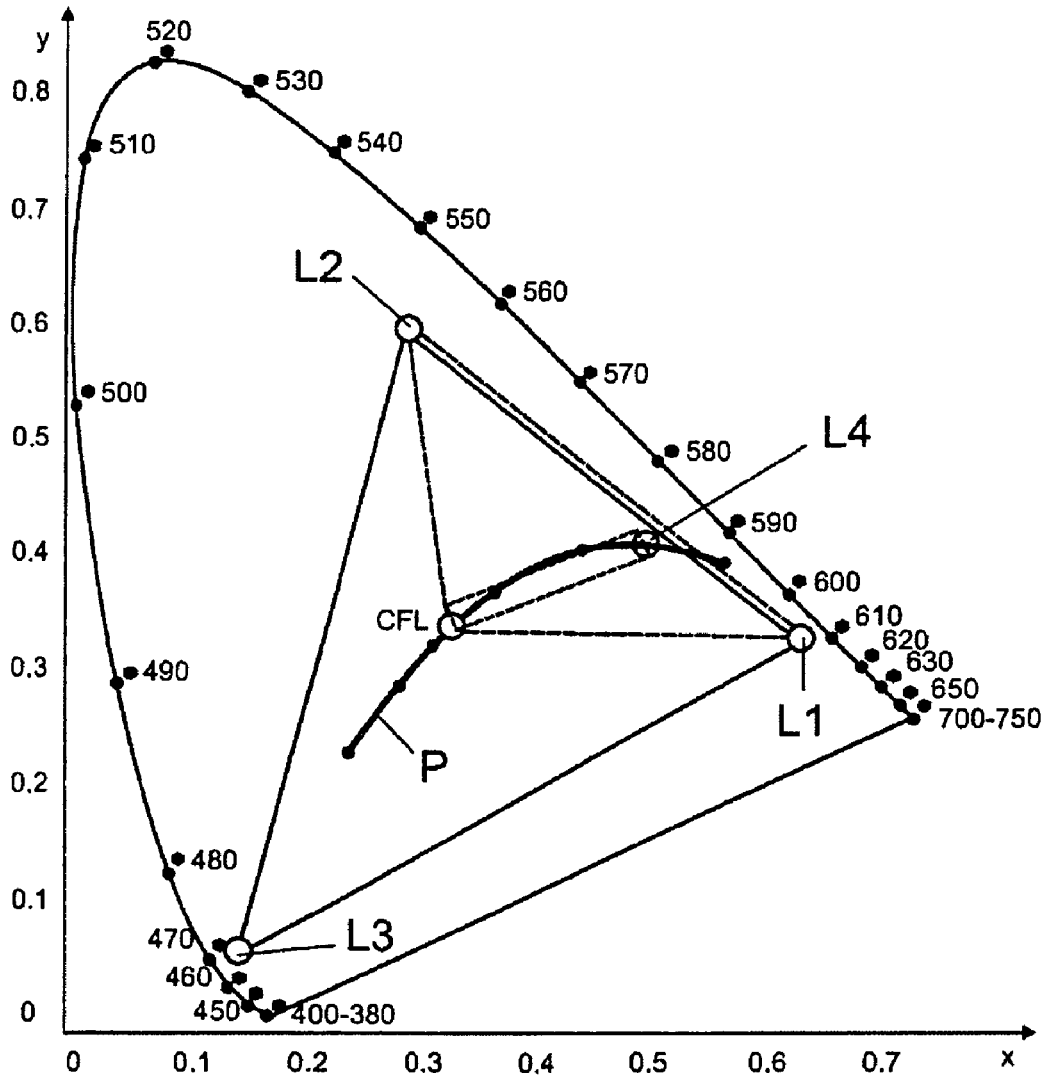
Figure 7:
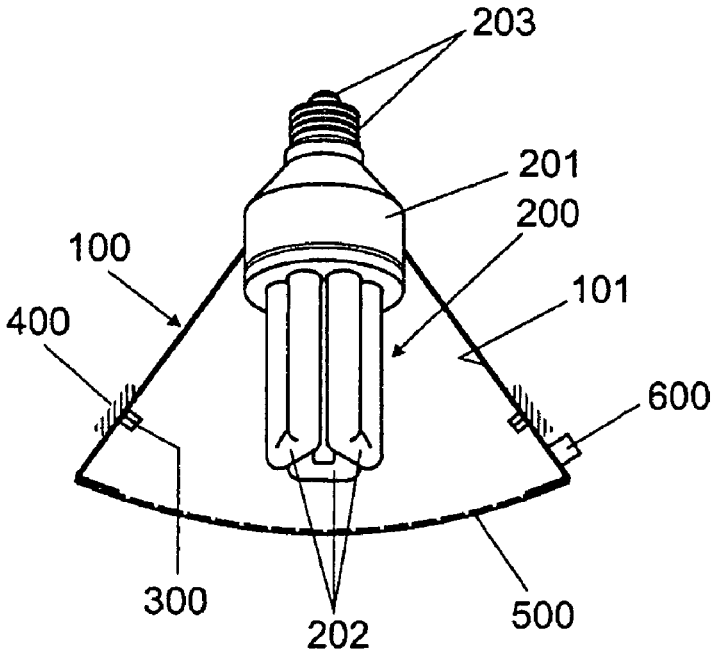
Figure 8:
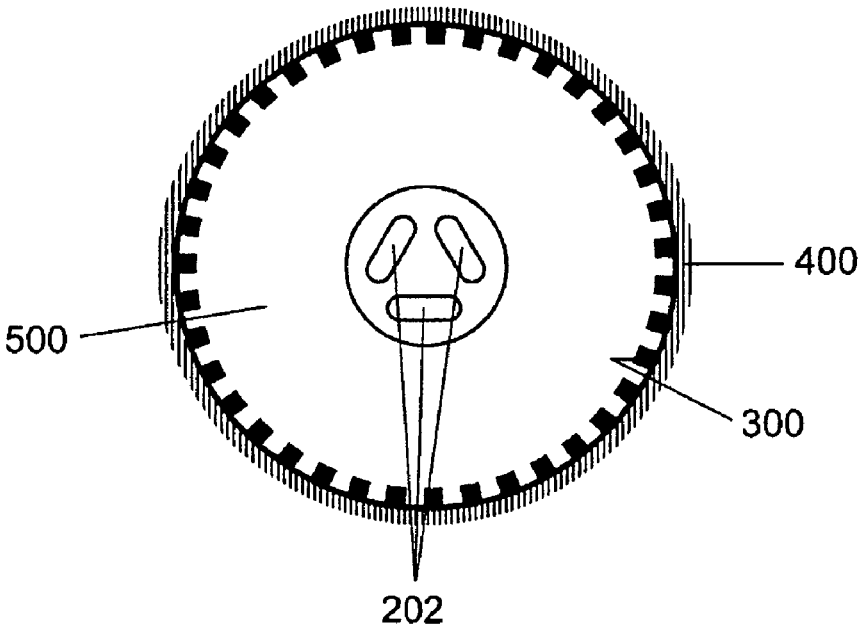
Figure 9:
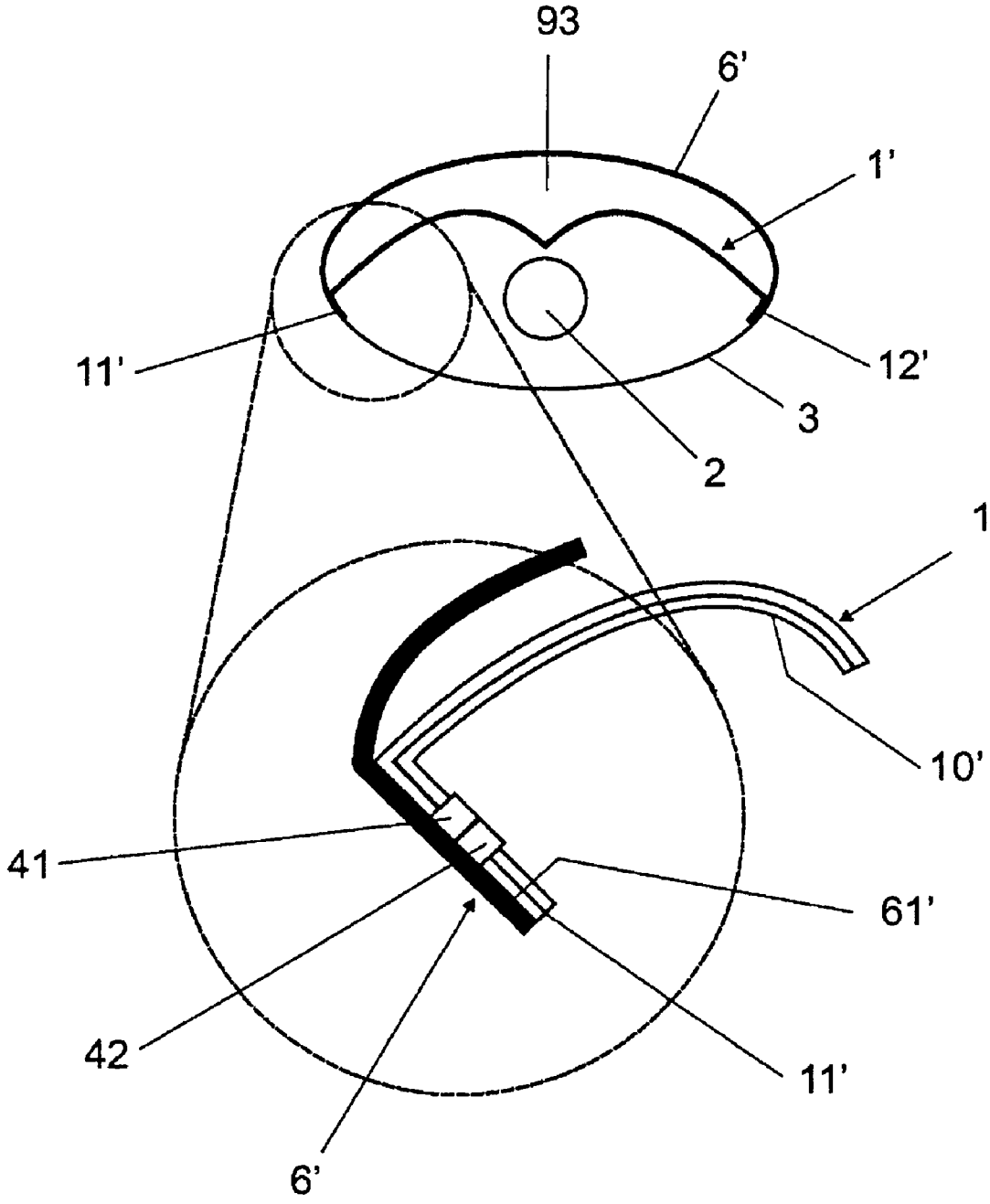

The invention is explained below in more detail with the aid of a few preferred exemplary embodiments. In the drawing:

FIG. 1 shows a schematic cross section through a luminaire in accordance with the first exemplary embodiment of the invention, FIG. 2 shows a schematic plan view of the luminaire in accordance with the first exemplary embodiment, FIG. 3 shows an enlarged illustration of the light-emitting diode arrangement and cooling device illustrated in FIG. 1, FIG. 4 shows a schematic cross section through a luminaire in accordance with the second exemplary embodiment of the invention, FIG. 5 shows a schematic plan view of the luminaire in accordance with the second exemplary embodiment, FIG. 6 shows an illustration of the standard color chart in accordance with DIN 5033, with the color loci of the light sources used in the exemplary embodiments, FIG. 7 shows a schematic cross section through a luminaire in accordance with the third exemplary embodiment of the invention, FIG. 8 shows a schematic plan view of the luminaire in accordance with the third exemplary embodiment, and FIG. 9 shows a schematic, partially cutaway illustration of a luminaire in accordance with the fourth exemplary embodiment of the invention, with an enlargement of a view.

A luminaire in accordance with the first exemplary embodiment of the invention is illustrated schematically in FIGS. 1, 2 and 3. This luminaire comprises a trough-shaped reflector 1 that, for example, consists of a plastic press-drawn section, or of an aluminum plate. The inner side 10 of the reflector 1 is designed to reflect light. In the case of a plastic press-drawn section, the inner side 10 of the reflector 1 is, for example, metallized in order to achieve a high degree of light reflection. Arranged in the trough-shaped reflector 1 is a rod-shaped fluorescent lamp 2 whose fluorescent coating is designed in such a way that it emits a daylight-like light with a color temperature of 6000 kelvin during operation. The longitudinal axis of the fluorescent lamp 2 is aligned parallel to the longitudinal axis of the reflector 1. The reflector 1 is preferably designed with mirror symmetry with reference to its center line or longitudinal axis, and the fluorescent lamp 2 is arranged along the longitudinal axis such that the luminaire likewise has mirror symmetry. On both trough edges running parallel to its longitudinal axis, the reflector 1 has reflector sections 11, 12 bent back in the direction of the inner side 10 and of the trough bottom at an angle of approximately 90 degrees. These reflector sections 11, 12 delimit the light exit opening of the trough-shaped reflector 1. This light exit opening is covered by means of a transparent, light-scattering cover pane made from plastic 3. As further light sources, the luminaire has two light-emitting diode arrangements 4, 5 that respectively comprise a multiplicity of light-emitting diode pairs 41, 42 and 51, 52, respectively, each light-emitting diode pair 41, 42 being formed by a light-emitting diode shining red 41 or 51, and green 42 or 52. Each light-emitting diode arrangement 4, 5 is assigned a cooling device 6, 7, fitted with cooling ribs 60, 70, for the light-emitting diode pairs 41, 42, 51, 52. The cooling devices 6, 7 are, for example, respectively an aluminum plate that has cooling ribs 60 and 70, respectively, integrally formed on one side. The light-emitting diode arrangements 4, 5 and the cooling devices 6, 7 extend over the entire length of the trough-shaped reflector 1. The light-emitting diodes 41, 42 and 51, 52, respectively, are mounted on a flat surface 61 or 71, averted from the cooling ribs 60 or 70, of the cooling device 6 or 7. This surface 61 or 71 of the cooling device 6 or 7 is fastened on the outer side of the bent-back reflector section 11 or 12 via a thermal insulation layer 8, the light-emitting diode pairs 41, 42 or 51, 52 respectively projecting through well-fitting cutouts in the respective reflector section 11 or 12, such that they face the inner side 10 of the reflector 1. The insulation layer 8 is, for example, a plastic of low thermal conductivity. The cooling devices 6 or 7 with the light-emitting diode pairs 41, 42 or 51, 52 mounted thereon can be fastened on the bent-back reflector sections 11 or 12 by means of screws, clamps, adhesives or similar fastening means, for example. It is possible, if appropriate, to dispense with the thermal insulation layer 8 when the reflector 1 is fabricated from a plastic press-drawn section. The light-emitting diode pairs 41, 42 and 51, 52, respectively, of the two light-emitting diode arrangements 4 or 5 are respectively arranged equidistantly along a straight line running parallel to the longitudinal axis of the reflector 1 on either side of the fluorescent lamp 2. Electrical connections 9 for supplying energy to the fluorescent lamp 2 and the light-emitting diode arrangements 4, 5 project from the end faces of the reflector 1. A color sensor 91 and a brightness sensor 92 are fastened on the outer side of the reflector 1 in order to enable the color and brightness of the light emitted by the luminaire to be controlled as a function of the natural ambient light. The operating circuits for the fluorescent lamp 2 and the light-emitting diode arrangements 4, 5 are arranged outside the reflector 1 and therefore not illustrated in the figures. The luminaire can additionally have a housing in which the above-mentioned operating circuits are accommodated. In the case of the plan view in accordance with the schematic FIG. 2, the light-emitting diode arrangements 4 and 5, respectively, having the light-emitting diodes 41, 42 or 51, 52 are normally not visible because they are covered by the cooling device 6 or 7 and the cooling ribs 60 or 70 as well as the reflector sections 11 or 12.

During operation, the fluorescent lamp 2 generates white light with a color temperature of approximately 6000 kelvin. The light-emitting diodes 41, 42 and 51, 52, respectively, which lie closely next to one another, of each light-emitting diode pair generate red and green light that, after reflection on the inner side 10 of the reflector 1 and passing of the light-scattering cover pane 3, is added as yellowish mixed light to the bluish, daylight-like light of the fluorescent lamp in a homogeneous fashion such that the light emitted by the luminaire has a color temperature that is reduced by comparison with the light generated by the fluorescent lamp 2. The red light-emitting diodes 41 and 51, respectively, can be dimmed independently of the green light-emitting diodes 42 or 52, that is to say the brightness of the red and green light-emitting diode light that is added to the fluorescent lamp light can be controlled independently of one another. It is possible thereby for the color locus of the light emitted by the luminaire to be shifted from the color locus of the fluorescent lamp with a color temperature of 6000 kelvin to a color locus with reduced color temperature. Illustrated in FIG. 6 is the standard color chart in accordance with DIN 5033 with the color loci FL, L1, L2 of the light emitted by the fluorescent lamp 2 (color locus FL) and by the red (color locus L1) and green (color locus L2) light-emitting diodes 41, 42, 51, 52. Furthermore, the color locus L3 of a blue light-emitting diode and a warm white light-emitting diode (color locus L4) is also plotted, as is the Planckian locus P, which corresponds to the light emitted by a black-body radiator for different incandescent temperatures. The rectangle drawn in dashes in FIG. 6 delimits the color loci belonging to the white light. The color temperature of the light falls along the Planckian locus P with increasing color coordinates x and y. The color temperature is 6000 kelvin at the color locus FL of the fluorescent lamp, and the color temperature is approximately 2300 kelvin at the color locus L4 of the warm white light-emitting diode and/or at the point of intersection of the connecting line between the color loci L1, L2. The brightness of the light generated by the red and green light-emitting diodes 41, 42, 51, 52 and by the fluorescent lamp 2 is preferably controlled in such a way that the luminaire emits white light with a color temperature in the range from 2700 kelvin to 6000 kelvin. The brightness of the abovenamed light sources 2, 41, 42, 51, 52 can be controlled continuously, and consequently it is also possible for the color temperature to be varied continuously in the abovenamed range.

As may be seen from FIG. 6, a similar effect can also be attained by combining the fluorescent lamp 2 with warm white light-emitting diodes. That is to say, instead of the red and green shining light-emitting diode pairs 41, 42 and 51, 52, respectively, it is also possible to make use in accordance with FIGS. 1 to 3 of light-emitting diodes generating warm white light. Light-emitting diodes generating warm white light are, for example, light-emitting diodes based on blue light-emitting diodes that are equipped with a conversion means in order to convert the blue light into white light of lower color temperature (approximately 2300 kelvin). By varying the brightness of the light generated by the fluorescent lamp and/or the warm white light-emitting diodes, the color temperature of the light emitted by the luminaire can be continuously varied.

The color temperature and the brightness of the light emitted by the luminaire in accordance with the first exemplary embodiment are preferably automatically controlled with the aid of the color and light sensor 91, 92 as a function of the natural ambient light by an external central control device to which a multiplicity of inventive luminaires can be or are connected. The central control device communicates via bidirectional control lines with the operating circuits of the inventive luminaires and, if appropriate, with further, conventional luminaires that belong to the illumination system. These control lines are used to transmit control commands to the operating circuits and to interrogate operating states of the individual luminaires. The communication between the central control device and the operating circuits of the individual luminaires on the illumination system is performed according to the DALI standard (DALI stands for Digitally Addressable Lighting Interface). The central control device and the color and brightness sensors 91, 92 can be used in conjunction with the communication in accordance with the DALI standard to ensure automatic control of the inventive luminaires as a function of the ambient light, without the occurrence of an appreciable color scattering in the case of the light emitted by a number of inventive luminaires.

A second exemplary embodiment of the inventive luminaire is illustrated schematically in FIGS. 4 and 5. This second exemplary embodiment differs from the first exemplary embodiment only in that, instead of the fluorescent lamp 2 with a base at two ends in accordance with the first exemplary embodiment, use is made of a fluorescent lamp 2' with a base at one end, and the luminaire correspondingly has electric connections 9' for the fluorescent lamp 2' and the light-emitting diode arrangements 4, 5 that project only at one end face of the reflector 1. The first and second exemplary embodiments correspond in all other details. Consequently, the same reference numerals are used for identical components in FIGS. 1 to 3 and 4 to 5.

A third exemplary embodiment of an inventive luminaire is illustrated schematically in FIGS. 7 and 8 and is principally provided for use in private spaces and in the housing sector. This luminaire has a hood-like, in particular funnel-shaped reflector 100, a compact fluorescent lamp 200 as first light source, and a light-emitting diode arrangement 300 as second light source as well as a transparent, light-scattering cover pane 500 for the light exit opening of the reflector 100, and a cooling device 400 for cooling the light-emitting diode arrangement. The reflector 100 is arranged with its narrow opening at the base 201 of the compact fluorescent lamps 200 such that the electrical connections 203 of the fluorescent lamp or the luminaire project from the reflector 100. The reflector 100 consists, for example, of a plastic injection-molded part. The inner side 101 of the funnel-shaped, rotationally symmetrical reflector 100 is designed to reflect light. To this end, the inner side 101 is preferably metallized, for example provided with an aluminum layer. The fluorescent lamp 200 is arranged in the rotation axis of the reflector 100 such that the limbs of the U-shaped sections 202 of the lamp vessel run parallel to the rotational axis of the reflector 100. The light-emitting diode arrangement 300 is arranged on the inner side 101 of the reflector 100 in an annular fashion around the lamp vessel sections 201. It consists of a combination of light-emitting diodes that shine red, green and blue and are respectively present in the same number. The fluorescent coating of the fluorescent lamp 200 is designed such that the fluorescent lamp 200 generates cold white light during operation, that is to say white light with a color temperature of approximately 4000 kelvin. The cooling device 400 is arranged on the outer side of the reflector 100 at the level of the light-emitting diode arrangement 300. By way of example, the cooling device 400 is an annular aluminum body on whose surface the light-emitting diodes of the light-emitting diode arrangement 300 are mounted such that the light-emitting diodes project into the interior of the reflector 100 through cutouts in the reflector 100. The operating circuit for the fluorescent lamp 200 and the light-emitting diode arrangement 300 is accommodated in the interior of the lamp base 201, for example. The electrical connection between the light-emitting diode arrangement 300 and its operating circuit can be achieved, for example, via electrical lines that are embedded as conductor tracks in the plastic material of the reflector 100 or are guided along the reflector 100 to the lamp base 201. For example, the reflector 100 can be fixed on the base 201 by means of a metallic latching or snap connector that simultaneously also produces the electrical connection between the operating circuit accommodated on the base and the light-emitting diode arrangement 300.

During operation, the fluorescent lamp generates white light that has a color temperature of approximately 4000 kelvin and is homogeneously mixed with the light of the light-emitting diodes 300 by means of the reflector 100 and the light-scattering cover pane 500 such that the luminaire can emit light with a cover temperature in the range from approximately 2700 kelvin to 4000 kelvin. In addition to the switch-on head, it is preferred for the luminaire to be provided with a further switch with the aid of which a number of, for example two or three, predetermined differing color temperatures can be selected for the white light emitted by the luminaire. In addition, it is possible to fit on the outer side of the reflector 100 a color and brightness sensor 600 that enables automatic and continuous control of color and brightness of the white light emitted by the luminaire as a function of the ambient air as has already been described in conjunction with the previous exemplary embodiments. Furthermore, in order to generate colored light it is possible to provide a controller that is to be actuated manually and enables the red, green and blue light-emitting diodes to be continuously controlled manually for brightness in a fashion independent of one another in order to vary the color locus and the color of the light emitted by the luminaire in the triangle delimited in FIG. 6 by the points L1, L2 and L3, including outside the Planckian locus P.

FIG. 9 illustrates schematically a fourth exemplary embodiment of an inventive luminaire. This fourth exemplary embodiment is substantially identical to the first exemplary embodiment. Consequently, the same reference numerals are used in FIGS. 1 and 3 for identical components. The fourth exemplary embodiment differs from the first exemplary embodiment only in the reflector 1' and the cooling device 6' for the light-emitting diodes 41, 42, 51, 52 of the light-emitting diode arrangements 4, 5. The reflector 1' has the same shape as the reflector 1 in accordance with the first exemplary embodiment. However, the reflector 1' consists of a plastic press-drawn section and not of an aluminum plate as does the reflector 1 of the first exemplary embodiment. The inner side of the trough-shaped reflector 1' is formed by an aluminum layer 10' that has a high degree of light reflection. The cooling device 6' consists of a metal plate, for example an aluminum plate that extends over the entire length of the luminaire and the trough-shaped reflector 1'. The angled-away edge sections 11', 12' of the trough-shaped reflector 1' are provided with cutouts through which the light-emitting diodes 41, 42 and 51, 52, respectively, project such that their light is emitted in the direction of the inner side 10' of the reflector 1'. The cooling plate 6' surrounds the reflector 1' like a hood such that the reflector 1' and the cooling plate 6' form an interspace 93 in which there is preferably arranged an operating device or an operating circuit for the fluorescent lamp 2 and the light-emitting diodes 41, 42, 51, 52 of the light-emitting diode arrangements 4, 5. The cooling plate 6' bears against the outer side of the angled-away, bent-back edge sections 11' and 12' of the reflector 1' and is fastened thereon. The light-emitting diodes 41, 42, 51, 52 are mounted on the surface 61' of the cooling plate 6' facing the reflector 1' such that the light-emitting diodes 41, 42 of the first light-emitting diode arrangement 4 project through cutouts in the first angled-away reflector section 11', and the light-emitting diodes 51, 52 of the second light-emitting diode arrangement 5 project through cutouts in the second angled-away, bent-back reflector section 12'. The plastic material of the reflector 1' acts here as a thermal insulation layer between the cooling plate 6' and the inner side 10' or of the interior of the reflector 1'. The light exit opening of the reflector 1', which is delimited by the two angled-away reflector sections 11', 12' and the cooling plate 6', is provided with a transparent, light-scattering cover 3. In all other details, the fourth exemplary embodiment corresponds to the first exemplary embodiment.

The invention claimed is:

1. A luminaire having a first light source, which generates white light and comprises at least one fluorescent lamp or one incandescent lamp, and having a second light source, which comprises at least one light-emitting diode arrangement, and having a reflector for the light emitted by the light sources, a cooling device for the at least one light-emitting diode arrangement being provided that is thermally coupled to the at least one light-emitting diode arrangement and is arranged on the reflector, and the luminaire comprising a transparent, light-scattering means that is arranged in the beam path of the light emitted by the luminaire;

said reflector having an inner side that faces said light sources and is designed to reflect light, and an outer side averted from said light sources, wherein said cooling device is arranged on the outer side of said reflector; and wherein said at least one light-emitting diode arrangement is mounted on a surface of said cooling device which faces said outer side of the reflector, and said at least one light-emitting diode arrangement projecting through cutouts in said reflector.

2. The luminaire as claimed in claim 1, in which the cooling device is fastened on the reflector.

3. The luminaire as claimed in claim 1, in which the cooling device is arranged at the edge of a light exit opening of the reflector.

4. The luminaire as claimed in claim 1, in which the at least one light-emitting diode arrangement (4, 5; 300) is arranged on the inner side (10; 10'; 101) of the reflector (1; 1'; 100).

5. The luminaire as claimed in claim 1, in which a thermal insulation layer (8) is arranged between the outer side of the reflector (1; 100) and the surface (61) of the cooling device (6, 7; 400) provided with the at least one light-emitting diode arrangement (4, 5; 300).

6. The luminaire as claimed in claim 1, in which the cooling device (6, 7) has cooling ribs (60, 70) that are arranged and aligned in such a way that they lie outside the beam path of the light emitted by the luminaire.

7. The luminaire as claimed in claim 1, in which the cooling device is designed as a cooling plate (6') that is arranged and shaped in such a way that it lies outside the beam path of the light emitted by the luminaire.

8. The luminaire as claimed in claim 7, in which the cooling plate (6') and the reflector (1') form a cavity or interspace (93).

9. The luminaire as claimed in claim 1, in which the at least one light-emitting diode arrangement (4, 5) comprises a combination of red or orange shining light-emitting diodes (41, 51) with green shining light-emitting diodes (42, 52), and the first light source comprises one or more fluorescent lamps (2, 2').

10. The luminaire as claimed in claim 1, in which the at least one light-emitting diode arrangement comprises light-emitting diodes that emit warm white light during their operation, and the first light source comprises one or more fluorescent lamps.

11. The luminaire as claimed in claim 9 or 10, in which the at least one fluorescent lamp (2, 2') is designed in such a way that it emits daylight-like light during its operation.

12. The luminaire as claimed in claim 1, in which the at least one light-emitting diode arrangement (300) comprises a combination of red, green and blue shining light-emitting diodes.

13. The luminaire as claimed in claim 12, in which the first light source comprises one or more fluorescent lamps (2, 2', 200).

14. The luminaire as claimed in claim 1, in which the transparent, light-scattering means is designed as a cover pane (3; 500) for a light exit opening of the reflector (1; 1'; 100).

15. The luminaire as claimed in claim 1, in which a color sensor (91) that serves to control the color temperature or the color of the light emitted by the luminaire is coupled to the luminaire.

16. The luminaire as claimed in claim 1, in which a brightness sensor (92) that serves to control the brightness of the light emitted by the luminaire is coupled to the luminaire.

17. The luminaire as claimed in claim 1, in which the reflector (1, 1') is of trough-like design, the first light source (2, 2') is aligned parallel to the longitudinal extent of the trough-like reflector (1, 1'), and the second light source is formed by two light-emitting diode arrangements (4, 5) that are arranged on both sides of the first light source (2, 2') and respectively extend in a fashion parallel to the longitudinal extent of the reflector (1, 1').

18. The luminaire as claimed in claim 17, in which the cooling devices (6, 7) of the two light-emitting diode arrangements (4, 5) are respectively arranged along a reflector edge running parallel to the longitudinal extent of the trough-like reflector (1, 1').

19. The luminaire as claimed in claim 17 or 18, in which the two light-emitting diode arrangements (4, 5) are respectively arranged along a reflector section (11, 12, 11', 12') bent back in the direction of the inside trough bottom, such that, before leaving the luminaire, the light emitted by the light-emitting diode arrangements (4, 5) is reflected at least once on the inner side (10; 10'), designed to reflect light, of the reflector (1; 1').

20. The luminaire as claimed in claim 1, in which the cooling devices (6, 7) of the two light-emitting diode arrangements (4, 5) extend along the outer sides of the bent-back reflector sections (11, 12; 11', 12').

21. The luminaire as claimed in claim 1, in which the light exit opening of the reflector (1; 1') is arranged between the bent-back reflector sections (11, 12; 11', 12').

22. The luminaire as claimed in claim 1, in which the reflector (100) is of hood-like and substantially rotationally symmetrical design, and the first light source (200) is arranged along the rotation axis of the reflector (100), and the second light source comprises at least one annular or annular segment light-emitting diode arrangement (300) that is arranged on the inner side (101) and coaxially with the rotation axis of the reflector (100).

23. The luminaire as claimed in claim 22, in which the cooling device (400) for the at least one annular or annular segment light-emitting diode arrangement (300) is arranged on the outer side of the reflector (100), at the level of the light-emitting diode arrangement (300).

24. The luminaire as claimed in either of claims 22 and 23, in which the first light source is a fluorescent lamp (200) with a base at one end and whose axis of longitudinal extent is aligned parallel to the rotation axis of the reflector (100).

25. The luminaire as claimed in claim 24, in which the fluorescent lamp with a base at one end is designed as a compact fluorescent lamp (200) with an operating device arranged in the base.

26. The luminaire as claimed in claim 1, in which the reflector (100) is fixed on the base (201) of the fluorescent lamp (200).

* * * * *